US006701576B2

(12) United States Patent
Michalak

(10) Patent No.: US 6,701,576 B2
(45) Date of Patent: Mar. 9, 2004

(54) DOOR HINGE WITH INTEGRATED DOOR STOP

(75) Inventor: Markus Michalak, Langenfeld (DE)

(73) Assignee: Edscha AG, Remscheid (DE)

( * ) Notice: Subject to any disclaimer, the term of this patent is extended or adjusted under 35 U.S.C. 154(b) by 0 days.

(21) Appl. No.: 10/220,191

(22) PCT Filed: Feb. 16, 2001

(86) PCT No.: PCT/DE01/00620

§ 371 (c)(1),
(2), (4) Date: Aug. 28, 2002

(87) PCT Pub. No.: WO01/65041

PCT Pub. Date: Sep. 7, 2001

(65) Prior Publication Data

US 2003/0028999 A1 Feb. 13, 2003

(30) Foreign Application Priority Data

Feb. 29, 2000 (DE) ..... 100 09 375

(51) Int. Cl.[7] ..... E05D 11/10
(52) U.S. Cl. ..... 16/334; 16/50; 16/330
(58) Field of Search ..... 16/319, 330, 321, 16/322, 374, 334, 366, 50, 54; 296/146.11

(56) References Cited

U.S. PATENT DOCUMENTS

| | | | | | |
|---|---|---|---|---|---|
| 833,734 | A | * | 10/1906 | Diehl | 16/286 |
| 2,516,935 | A | * | 8/1950 | Weaver | 16/50 |
| 2,890,477 | A | | 6/1959 | Miller | 16/140 |
| 5,102,084 | A | * | 4/1992 | Park | 248/286.1 |
| 5,346,272 | A | | 9/1994 | Priest et al. | 296/146.11 |
| 5,408,726 | A | * | 4/1995 | Kent | 16/326 |
| 5,867,872 | A | | 2/1999 | Katoh | 16/337 |
| 5,920,960 | A | * | 7/1999 | Kluting | 16/334 |
| 6,055,706 | A | * | 5/2000 | Dioguardi et al. | 16/226 |
| 6,282,752 | B1 | | 9/2001 | Kluting et al. | 16/334 |
| 6,516,495 | B1 | * | 2/2003 | Michalak | 16/320 |

FOREIGN PATENT DOCUMENTS

| | | | | |
|---|---|---|---|---|
| DE | 3602718 | A1 | * | 8/1987 |
| DE | 19619473 | | | 11/1997 |
| DE | 29821171 | U1 | * | 5/2000 |
| JP | 2002-103972 | A | * | 4/2002 |

* cited by examiner

*Primary Examiner*—Chuck Y. Mah
(74) *Attorney, Agent, or Firm*—Davidson, Davidson & Kappel, LLC

(57) ABSTRACT

A door hinge with integrated door stop includes a first half, which may be mounted to one of the door arrangement components, the door or door post; a second hinge half, which may be mounted to the other door arrangement; a hingepin, mounted in the first hinge half with a running fit and in the second hinge half with a non-rotating fit; a brake and retaining device which, dependent upon the hinge angle between the first and second hinge halves defines stop positions and essentially comprises two co-operating components with stopmarks complementary to each other and a pressure spring, with an axis arranged parallel to and radially displaced from the hinge axis. A door stop, integrated in a door hinge for motor vehicle doors gives a positioning of the door, with a small construction embodiment and low operating noise, whereby the door is held in each position with adequate force substantially independent from possible tolerance variations. Both of the co-operating parts move in a counter direction to the first and second hinge halves, depending on the hinged displacement.

8 Claims, 3 Drawing Sheets

DOOR HINGE WITH INTEGRATED DOOR STOP

BACKGROUND OF THE INVENTION

The invention relates generally to a door hinge and, in particular, to a door hinge with an integrated door stop.

The door stop described in DE-A 196 19 473 uses a holding device which is connected in a rotationally fixed manner to that half of the hinge in which the hinge pin is mounted rotatably with a running fit. The holding device is designed as a running path which is curved in the form of at least part of a ring and is arranged concentrically with respect to the axis of the hinge pin and has recesses which are formed in the axial direction of the hinge pin and form latching marks. Furthermore, the door stop provides braking and holding bodies which are formed as rolling bodies and are accommodated rotatably on a bearing spindle which is oriented transversely with respect to the hinge axis, and interact with the latching marks under load from a compression spring which is supported against the free end of the hinge pin, which latching marks are formed as recesses in the end side of a collar which projects and is arranged, in the form of at least part of a ring, concentrically with respect to the axis of the hinge pin. This design of a door stop advantageously leads to a hinge-stop unit which is relatively small and the design of which requires little installation space in the radial direction. Moreover, it has the advantage that it can be produced at low cost and works with little noise, but it is also inadequate in that the braking device and the holding device are arranged one above the other, oriented coaxially with respect to the hinge pin, and above the actual hinge eyelet. An arrangement of this type firstly results in the permissible diameter of the braking device and the holding device being determined substantially by the predetermined diameter ratios of the head roll of the hinge half, on the one hand, and the hinge pin, on the other hand. Furthermore, it is necessary to take into account the space required for accommodating the hinge-stop unit in the vehicle bodywork. The limited three-dimensional design options for the stop in this respect mean that, firstly, it is relatively difficult to achieve a relatively large number of latching or holding positions for the door at all and, secondly, it is also difficult to apply a sufficient braking and holding force. Particularly in the case of a relatively large number, for example more than two latching or holding positions, including with regard to the tolerance pairings which are to be taken into account and may be unfavorable, there are problems in that the predetermined braking and holding positions of the door cannot be maintained with sufficient accuracy or cannot be set with a sufficient braking or arresting force.

U.S. Pat. No. 5,867,872 shows a hinge having a braking device and having a holding device. In this case, one of the two devices, the braking device, is arranged on an axis which is parallel and radially offset with respect to the hinge axis and is driven as a function of the pivoting movement of the hinge. The intention of this is to achieve a higher braking force outside the region of the closed position.

U.S. Pat. No. 5,346,272 shows a car door hinge having a holding device which is arranged on an axis which is parallel and radially offset with respect to the hinge axis and is driven independently of the pivoting movement of the hinge. The intention of this is to achieve a greater number of latching positions.

SUMMARY OF THE INVENTION

The technical problem on which the invention is based consists in making it possible, in a mechanical braking and holding device for a door stop, to provide a multiplicity of latching and holding positions for the door, and of improving a door stop, which is integrated in a door hinge, for motor vehicle doors in such a manner that, while the door stop is designed to be as small as possible and moves with little noise, precise arresting of the door becomes possible and the door is held in the respective latching and holding position with sufficient force, while at the same time it is intended to ensure that all this is as far as possible independent of possible tolerance deviations.

The present invention provides a door hinge with an integrated door stop. The door hinge includes a first hinge half capable of being fitted to one of a door and a door pillar, a second hinge half capable of being fitted to the other of the door and the door pillar, a hinge pin, and a braking and holding device. The hinge pin defines a hinge axis and is accommodated in the first hinge half with a running fit and is accommodated in the second hinge half in a rotationally fixed manner and allowing a pivoting movement between the first and second hinge halves. The braking and holding device is disposed on a first axis parallel to and radially offset from the hinge axis. The braking and holding device includes a compression spring and two interacting parts. The two interacting parts each have at least one complementary latching mark so as to define a holding position as a function of a pivot angle between the first and second hinge halves. Each of the two interacting parts are driven in opposite directions as a function of the pivoting movement.

If at least one part of the braking and holding device is driven in rotation as a function of the pivoting movement between the first and second hinge halves, since the pivot angle of the door with respect to the bodywork is up to 90°, there are also only sectors of up to 90° for the three-dimensional accommodation of the latching or holding marks available on the surface of the rotating braking and holding device.

Therefore, according to the invention, it is proposed for the two parts of the braking and holding device to be driven in opposite directions, with the result that the sector areas for the three-dimensional arrangement of latching marks on the opposite end sides of the two parts advantageously become cumulative. Since the two parts and a compression spring which preloads them toward one another are arranged on an axis which is parallel and radially offset with respect to the hinge axis, the braking and holding device can be arranged laterally offset in a compact, space-saving design, so that the hinge functions are not impaired.

Furthermore, one exemplary embodiment has the advantage that, as a result of the two parts being preloaded toward one another, the frictional contact between latching elevation and the end face of the opposite device is spring damped, so that the production of noise remains controllable and tolerance deviations are compensated for.

If, in another exemplary embodiment, a transmission step-up ratio is provided in the drive between hinge axis and the braking and holding device, the sector areas which are available for accommodation of the latching marks on the opposite end sides of the device are increased again by the step-up factor.

An exemplary embodiment in which the oppositely directed driving of the two devices is effected by connecting an idler gear between them as reversing transmission in the drive of a device, it is possible to realize the transmission reversal with little additional space being required. The parallel arrangement of the hinge axis and the axis which is offset radially with respect thereto advantageously makes it possible to form the drives between the hinge axis and the devices arranged on the axis which is offset and parallel thereto by means of relatively inexpensive geared transmissions with external toothing. Arranging drive external toothing on the hinge spindle may be produced either integrally by suitably designing the hinge spindle itself or by means of the rotationally fixed arrangement of a gearwheel on the hinge spindle.

BRIEF DESCRIPTION OF THE DRAWINGS

The abovementioned and further advantages are clearly explained in the description of an exemplary embodiment which is illustrated in the appended drawing, in which.

DETAILED DESCRIPTION

Figure 1:
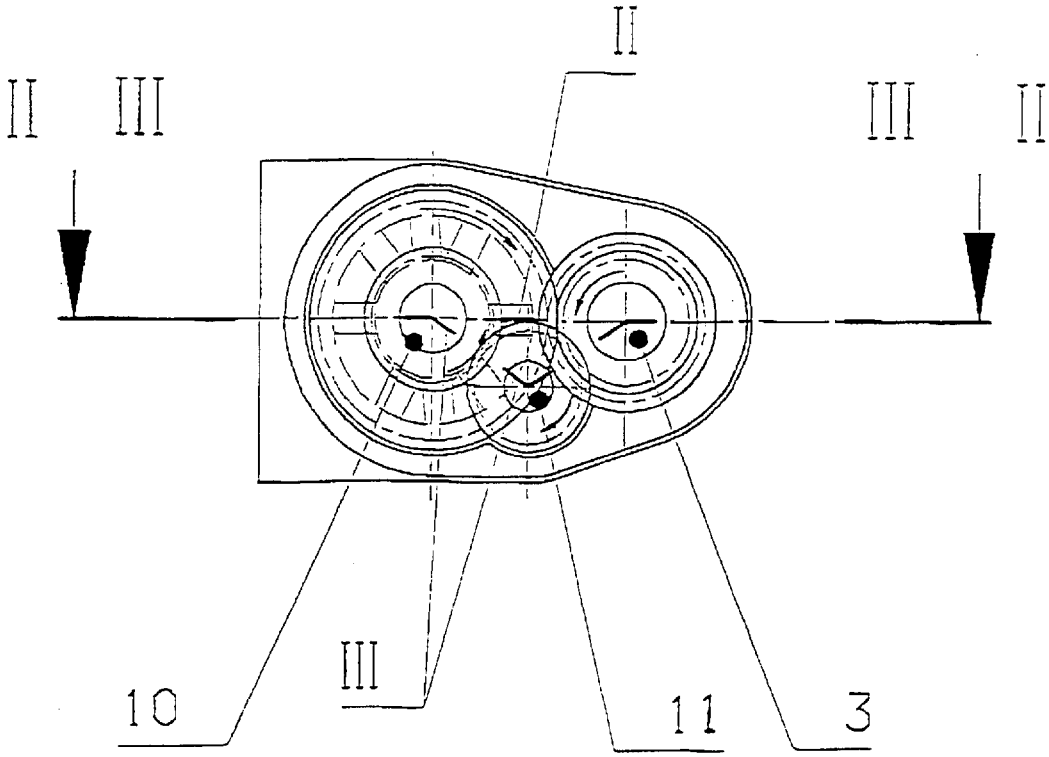
FIG. 1 shows a view from below, from a plane indicated by I—I in FIG. 2, of the door stop which is integrated in a door hinge.

FIG. 1 shows a view from below of the horizontally sectional, integrated door stop unit in the direction indicated by I—I in FIG. 2. It is clearly evident that in combination with these gearwheels, which are designed integrally or are rotationally fixed, the inclusion of the idler gear 11 in the transmission comprising gears which are arranged on the hinge spindle 3 and on the axis 10 arranged parallel thereto requires scarcely any additional space. The running direction of the gearwheels which are connected in a rotationally fixed manner, to the hinge spindle 3 and to the spindle arranged parallel thereto, having the axis 10, is identical, while the gear 6 arranged above them, which is positioned rotatably on the spindle which includes the axis 10, is driven in the opposite direction.

Figure 2:
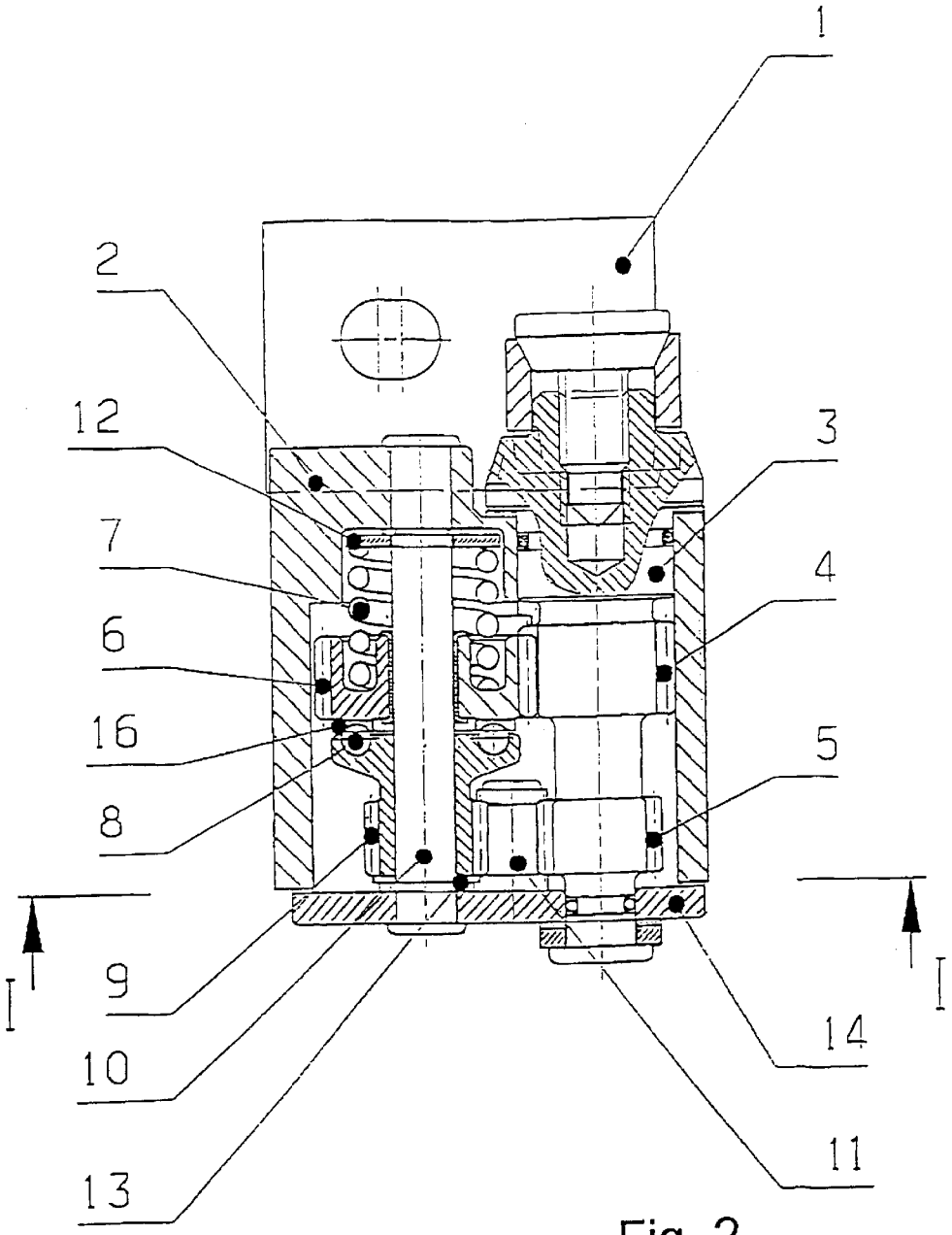
FIG. 2 shows a side view in the direction indicated by II—II in FIG. 1.

In the sectional view which is illustrated in FIG. 2, indicated by II—II in FIG. 1, it is clearly apparent that the axis of the hinge spindle 3 and the axis 10 of the laterally offset spindle run parallel. The gears 4 and 5 are formed integrally on the hinge spindle 3. The gear 4 meshes directly with the external toothing of the braking device 6, while the gear 5 meshes with the idler gear 11 and the latter meshes with the external toothing of the holding device 9. This transmission arrangement means that the holding device 9 rotates in the opposite direction to the braking device 6, as indicated by the arrows indicating the direction of rotation in FIG. 1. Balls are arranged in the end face of the holding device 9, as latching elevations. However, the latching elevations may also be designed as stationary cams or as rollers. Latching recesses 16, the cavity of which is matched in complementary form to the external contour of the latching ball 8, are formed in that end face of the braking device 6 which lies opposite the holding device 9. The compression spring 7 is arranged coaxially with respect to the two devices 6 and 9, on the spindle which includes the axis 10, and the spring is supported at the top against the upper end-joint face of the hinge part 2 or against the spacer washer 12 which bears against it, while at the bottom the spring rests in an annular incision in the braking device 6 and preloads the device 6, which is arranged movably on the spindle which includes the axis 10, toward the holding devices 9. A sliding disk 13 is arranged between the lower end face of the holding device 9 and the cover 14.

Figure 3:
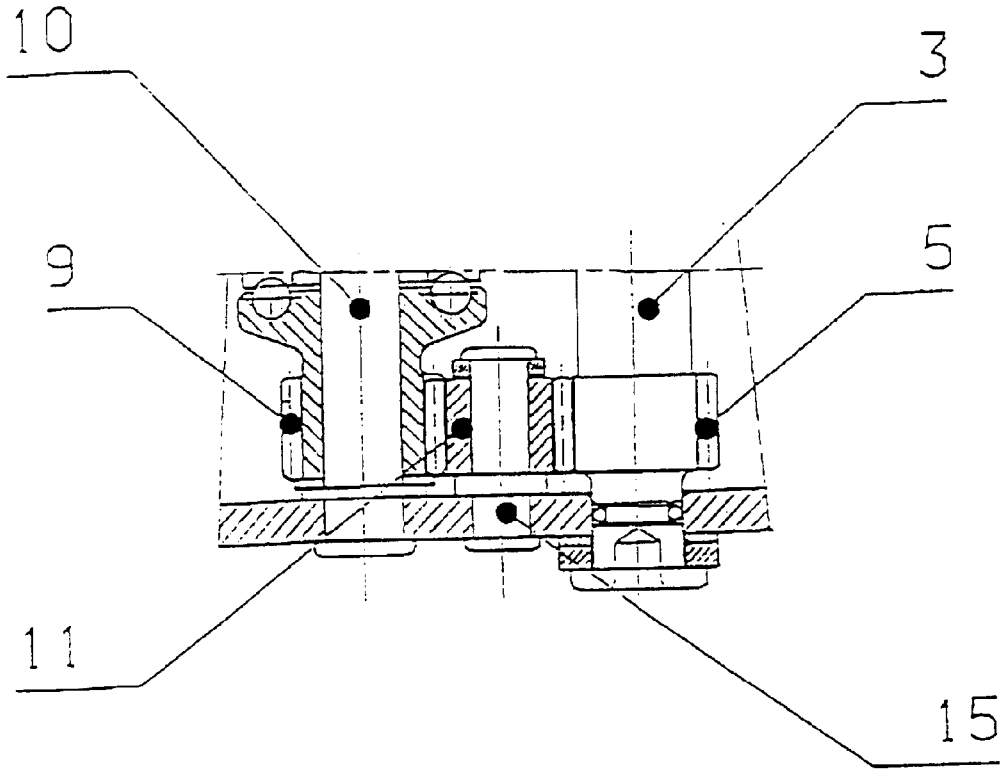
FIG. 3 shows a sectional side view of an excerpt from FIG. 2, but in the direction indicated by III—III in FIG. 1.

The lower part of FIG. 2 is also illustrated in section in FIG. 3, but in this case corresponding to section line III—III in FIG. 1. It can be seen once again from this figure that the reversing transmission comprises gear 5, idler gear 11 and external toothing of the holding device 9. The idler gear 11 is mounted on the lower cover 14 by means of the rivet stud 15.

What is claimed is:

1. A door hinge with an integrated door stop comprising:

a first hinge half capable of being fitted to one of a door and a door pillar;

a second hinge half capable of being fitted to the other of the door and the door pillar;

a hinge pin defining a hinge axis, the hinge pin being accommodated in the first hinge half with a running fit and being accommodated in the second hinge half in a rotationally fixed manner, the hinge pin allowing a pivoting movement between the first and second hinge halves; and a door stop including a braking and holding device, the braking and holding device including a braking device and a holding device, each disposed on a first axis with a running fit, the first axis being secured to the first hinge half, the braking device including at least one first latching element, the holding device including at least one second latching element, the hinge pin driving the braking device in a first direction with respect to the first axis and driving the holding device in a second direction opposite the first direction as a function of the pivoting movement, the at least one first latching element interacting with the at least second latching element as a function of the pivoting movement so as to define at least one holding position as a function of a pivot angle between the first and second hinge halves.

2. The door hinge as recited in claim 1, wherein the at least one first latching element includes at least one latching elevation and the at least one second latching element includes at least one latching recess complementary to the at least one latching elevation.

3. The door hinge as recited in claim 1, wherein the hinge pin includes a rotationally fixed first gear driving the braking device and a rotationally fixed second gear driving the holding device.

4. The door hinge as recited in claim 3, wherein the first gear is in meshing engagement with the braking device and the second gear is in meshing engagement with the holding device.

5. The door hinge as recited in claim 3, wherein the door stop includes an idle gear disposed in a rotationally fixed manner with respect to the first hinge half, the idle gear being driven by the hinge half and engaging one of the braking device and the holding device so as to provide a reversing transmission.

6. The door hinge as recited in claim 5, wherein the reversing transmission forms a step-up ratio with respect to the other of the braking device and the holding device.

7. The door hinge as recited in claim 1, further comprising a spring element fixed to the first hinge half and acting to preload one of the braking and the holding device with respect to the other.

8. The door hinge as recited in claim 7, wherein spring elment includes a compression spring defining a spring axis parallel to the first axis.

* * * * *